US011661772B2

(12) United States Patent
Molloy et al.

(10) Patent No.: US 11,661,772 B2
(45) Date of Patent: May 30, 2023

(54) WINDOW FASTENER

(71) Applicant: ASSA ABLOY NEW ZEALAND LIMITED, North Shore City (NZ)

(72) Inventors: Bryce Alan Molloy, Auckland (NZ); Lewis Joseph Isaacson, Auckland (NZ)

(73) Assignee: ASSA ABLOY NEW ZEALAND LIMITED, North Shore City (NZ)

( * ) Notice: Subject to any disclaimer, the term of this patent is extended or adjusted under 35 U.S.C. 154(b) by 178 days.

(21) Appl. No.: 16/651,167

(22) PCT Filed: Sep. 27, 2018

(86) PCT No.: PCT/NZ2018/050129
§ 371 (c)(1),
(2) Date: Mar. 26, 2020

(87) PCT Pub. No.: WO2019/066661
PCT Pub. Date: Apr. 4, 2019

(65) Prior Publication Data

US 2020/0270917 A1 Aug. 27, 2020

(30) Foreign Application Priority Data

Sep. 28, 2017 (NZ) ..... 735936

(51) Int. Cl.
*E05C 3/04* (2006.01)
*E05C 17/02* (2006.01)

(52) U.S. Cl.
CPC ..... *E05C 3/044* (2013.01); *E05C 17/02* (2013.01)

(58) Field of Classification Search
CPC ..... Y10T 292/1077; Y10T 292/57; Y10T 292/1039; Y10T 292/1041; Y10T 292/108;
(Continued)

(56) References Cited

U.S. PATENT DOCUMENTS 144,655 A * 11/1873 Burstow ..... E05B 65/0841 292/241
1,575,647 A * 3/1926 Thomas ..... E05C 3/145 292/332

(Continued)

FOREIGN PATENT DOCUMENTS

CA 2323397 A1 * 4/2001 ..... E05C 3/10
CN 204402207 6/2015

(Continued)

OTHER PUBLICATIONS

International Search Report and Written Opinion for International (PCT) Patent Application No. PCT/NZ2018/050129, dated Jan. 16, 2019, 8 pages.

(Continued)

*Primary Examiner* — Christine M Mills
*Assistant Examiner* — Steven A Tullia
(74) *Attorney, Agent, or Firm* — Sheridan Ross P.C.

(57) ABSTRACT

A window fastener including: a base configured for connection to a window sash; a handle carrying a latching tongue, pivotally connected to the base between a latched position and an unlatched position; and an interface between the base and the handle, wherein the interface causes the latching tongue to move axially closer to the base when the handle pivots from the unlatched position to the latched position; and wherein the interface causes the latching tongue to move axially away from the base when the handle pivots from the latched position to the unlatched position.

14 Claims, 14 Drawing Sheets

(58) Field of Classification Search
CPC ..... E05C 3/044; E05C 17/02; Y10S 292/20; Y10S 292/47
USPC ..... 292/336.3, 240, 241, 197, 200
See application file for complete search history.

(56) References Cited

U.S. PATENT DOCUMENTS

| | | | | |
|---|---|---|---|---|
| 1,750,423 | A * | 3/1930 | Oglesby | E05C 3/043 292/202 |
| 1,810,856 | A | 6/1931 | Schnell | |
| 5,219,193 | A | 6/1993 | Piltingsrud | |
| 5,505,505 | A * | 4/1996 | Follows | E05B 15/0053 292/58 |
| 5,634,357 | A * | 6/1997 | Nutter | E05B 13/106 70/203 |
| 5,769,469 | A | 6/1998 | Zemke | |
| 5,887,916 | A * | 3/1999 | Finkelstein | F24C 15/022 292/241 |
| 6,412,834 | B1 | 7/2002 | Waitai et al. | |
| 6,748,776 | B2 * | 6/2004 | Bullock | E05B 1/003 292/336.3 |
| 9,416,569 | B1 * | 8/2016 | Leone | E05C 5/02 |
| 9,422,755 | B2 | 8/2016 | Van Parys | |
| 2003/0200777 | A1 * | 10/2003 | Waschgler | E05B 13/106 70/210 |
| 2004/0026932 | A1 | 2/2004 | Coleman et al. | |
| 2006/0038414 | A1 * | 2/2006 | Jien | E05C 3/043 292/241 |
| 2016/0017634 | A1 * | 1/2016 | Parker | E05B 17/0058 292/336.3 |

FOREIGN PATENT DOCUMENTS

| | | | | |
|---|---|---|---|---|
| CN | 204571602 | | 8/2015 | |
| CN | 103953219 | | 4/2016 | |
| CN | 106050039 | | 10/2016 | |
| DE | 2659350 | A1 * | 7/1978 | B60J 7/185 |
| DE | 4125507 | A1 * | 3/1992 | E05B 3/06 |
| EP | 2362039 | | 8/2011 | |
| GB | 208864 | A * | 1/1924 | E05C 3/044 |
| GB | 2102484 | A * | 2/1983 | E05C 3/043 |
| GB | 2192927 | | 1/1988 | |
| GB | 2198178 | A * | 6/1988 | E05B 13/106 |
| GB | 2200944 | A * | 8/1988 | E05B 13/106 |
| GB | 2282178 | | 3/1995 | |
| GB | 2287744 | | 9/1995 | |
| JP | H04-107374 | | 9/1992 | |
| JP | 2000-073638 | | 3/2000 | |
| JP | 2004-092283 | | 3/2004 | |
| JP | 2014-098240 | | 5/2014 | |
| JP | 2016-094950 | | 5/2016 | |
| KR | 950006229 | Y1 * | 8/1995 | E05B 13/106 |
| KR | 200444785 | Y1 * | 6/2009 | E05C 3/10 |
| KR | 101401653 | | 6/2014 | |
| WO | WO-9012941 | A1 * | 11/1990 | E05C 3/10 |
| WO | WO-2008118028 | A1 * | 10/2008 | E05C 17/50 |
| WO | WO 2017/048133 | | 3/2017 | |

OTHER PUBLICATIONS

Official Action with English Translation for China Patent Application No. 201880063424.9, dated Jun. 17, 2021, 15 pages.
Official Action with English Translation for China Patent Application No. 201880063424.9, dated Apr. 1, 2022, 14 pages.
Official Action with English Translation for Japan Patent Application No. 2020-517808, dated Jun. 7, 2022, 8 pages.

* cited by examiner

WINDOW FASTENER

CROSS REFERENCE TO RELATED APPLICATIONS

This application is a national stage application under 35 U.S.C. 371 and claims the benefit of PCT Application No. PCT/NZ2018/050129 having an international filing date of 27 Sep. 2018, which designated the United States, which PCT application claimed the benefit of New Zealand Patent Application No. 735936 filed 28 Sep. 2017, the disclosure of each of which are incorporated herein by reference.

FIELD

The invention relates to a window fastener.

BACKGROUND

To latch a hung window in a closed position, it is common to have one or more handle-operated fasteners mounted with the sash. Wedged fasteners having a pivotally movable handle with a tongue which can engage on a wedge element are known. The fastener will generally be fastened to the window sash and the wedge to the window frame.

Fasteners may include two spaced-apart tongues, one being intended to fasten the window in a closed position and the other to fasten the window in a venting position. These fasteners have the advantage of providing a level of security against unauthorised entry through the window yet, at the same time, allow the window to be partially open to provide air flow into the building.

A further form of window fastener is the "wedgeless fastener", which relies on a movable flap to overlap the edge of the window frame when the sash is in the closed position. In many such fasteners, if the handle is not rotated sufficiently to allow the flap to rotate fully horizontal, the lower, inner end of the flap can fail to clear the upper, outer edge of the bottom side of the frame as the sash is pulled closed, and can strike against the frame, potentially damaging the frame, the sash and the fastener.

Providing a more robust flap or attachment mechanism may add cost and can be aesthetically detracting.

The present invention may provide an improved window fastener or at least provide the public or industry with a useful choice.

SUMMARY

According to one example embodiment there is provided a window fastener including: i. a base configured for connection to a window sash; ii. a handle carrying a latching tongue, pivotally connected to the base between a latched position and an unlatched position; and iii. an interface between the base and the handle, wherein the interface causes the latching tongue to move axially closer to the base when the handle pivots from the unlatched position to the latched position; and wherein the interface causes the latching tongue to move axially away from the base when the handle pivots from the latched position to the unlatched position.

It is acknowledged that the terms "comprise", "comprises" and "comprising" may, under varying jurisdictions, be attributed with either an exclusive or an inclusive meaning. For the specification, and unless otherwise noted, these terms are intended to have an inclusive meaning—i.e., they may be taken to mean an inclusion of the listed components which the use directly references, and possibly also of other non-specified components or elements.

Reference to any document in the specification does not constitute an admission that it is prior art, validly combinable with other documents or that it forms part of the common general knowledge.

BRIEF DESCRIPTION OF THE DRAWINGS

The accompanying drawings which are incorporated in and constitute part of the specification, illustrate embodiments of the invention and, together with the general description of the invention given above, and the detailed description of embodiments given below, explain the principles of the invention, in which.

DETAILED DESCRIPTION

The application describes a method of securing a window (for example an awning or casement window), using a single fastener or multiple fasteners. In a general sense, embodiments provide fasteners configured such that rotation of the handle 1 causes both rotational and axial movement of latching tongue. The latching tongue is pressed towards a window frame when the fastener rotates into a closed position, and is released away from the window frame when the fastener rotates into an open position.

Figure 1:
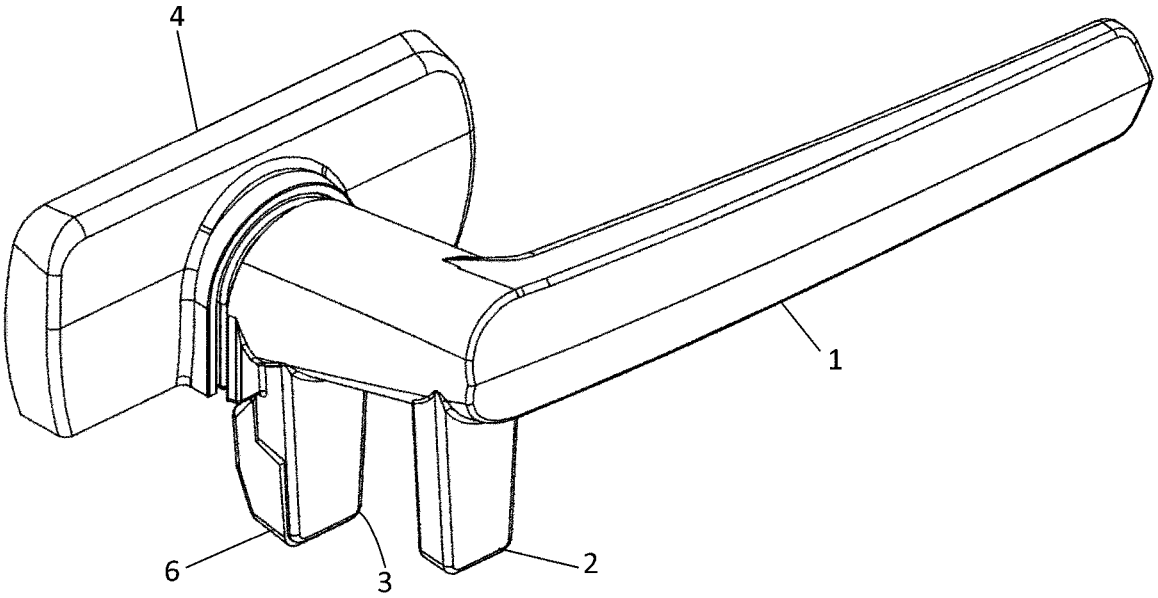
FIG. 1 is a front perspective view of a fastener.
Figure 2:
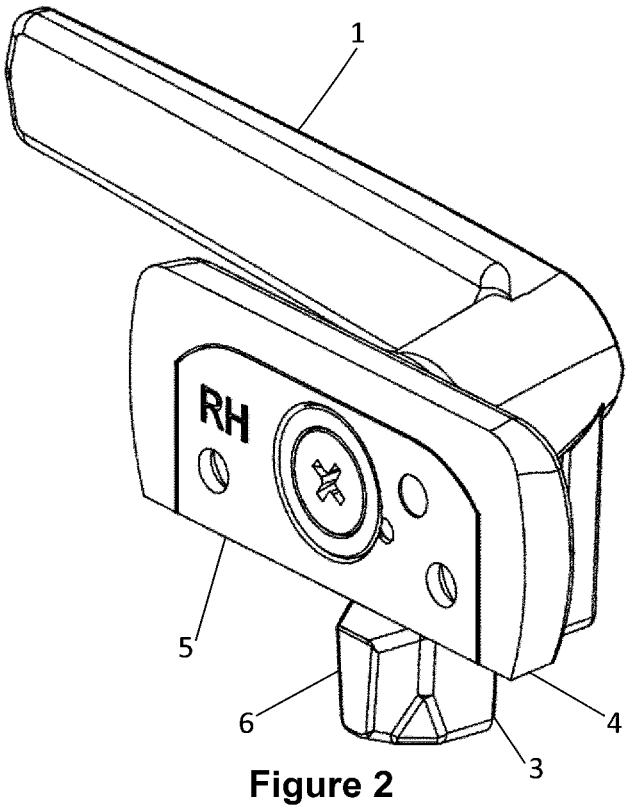
FIG. 2 is a back-perspective view of the fastener of FIG. 1.

FIG. 1 is a front perspective view of a fastener, and FIG. 2 is a back perspective view of the fastener of FIG. 1. The fastener includes a base 5, secured to the frame of a window, and a handle 1 for operating the fastener. A latching tongue 3 and, if present, a venting tongue 2 are carried with the handle 1. The latching tongue 3 and, if present, a venting tongue 2 are configured with wear surfaces to prevent damage to window frames (as will be described in more detail below).

Figure 3:
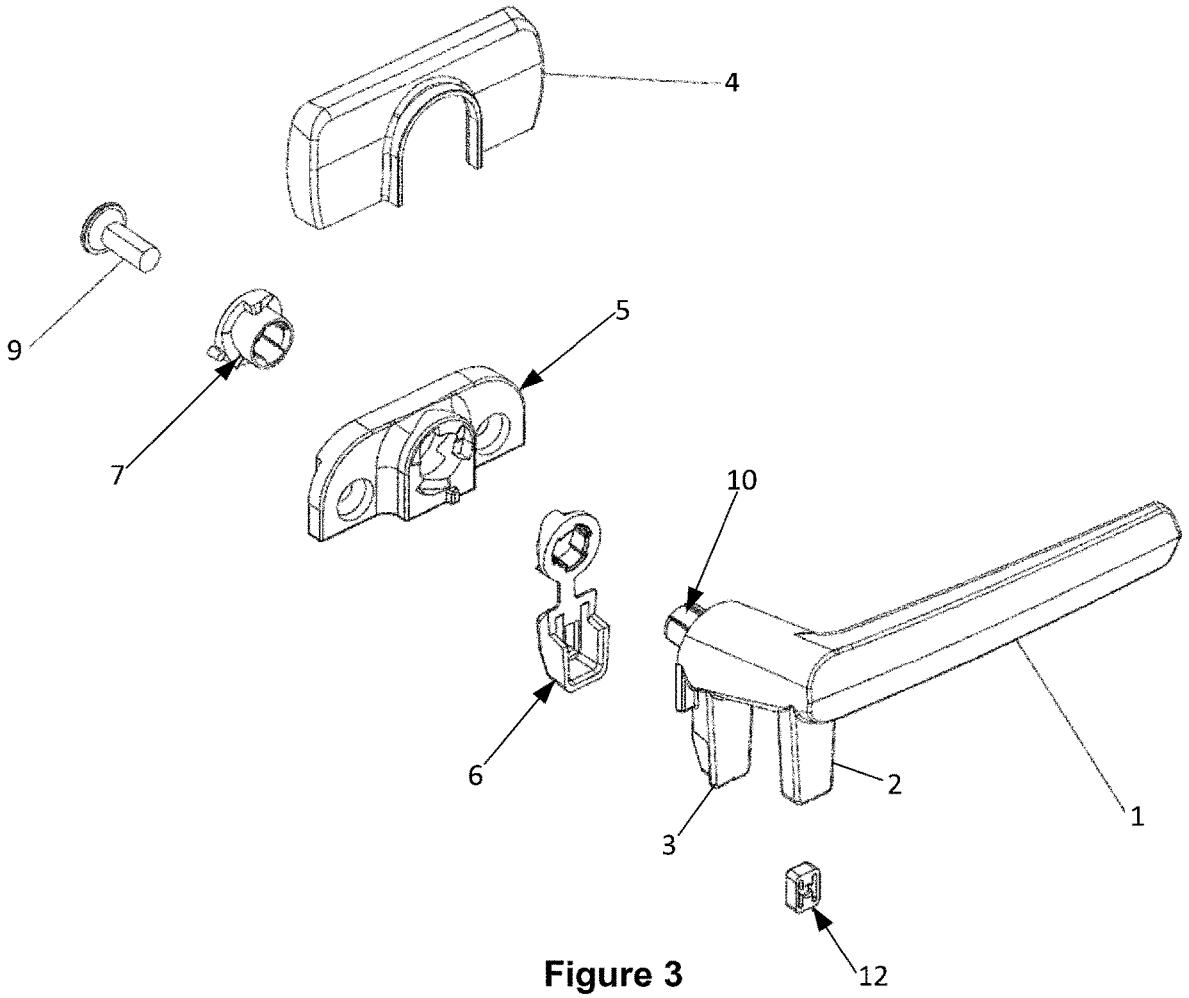
FIG. 3 is an exploded view of the fastener in FIG. 1.

FIG. 3 is an exploded view of the fastener in FIG. 1. A base 5 includes rear surfaces configured to interface with a rear washer 7 and front surfaces to interface with a tongue washer 6. The tongue washer 6 includes internal surfaces configured to interface with surfaces on the latching tongue 3 and a boss 10. The boss 10 protrudes from the handle 1 and rotationally aligns the handle 1, tongue washer 6 and rear washer 7. A cover 4 may house the base 5. A screw 9 may fix from the rear of the fastener into the handle 1.

Handle 1

Figure 4:
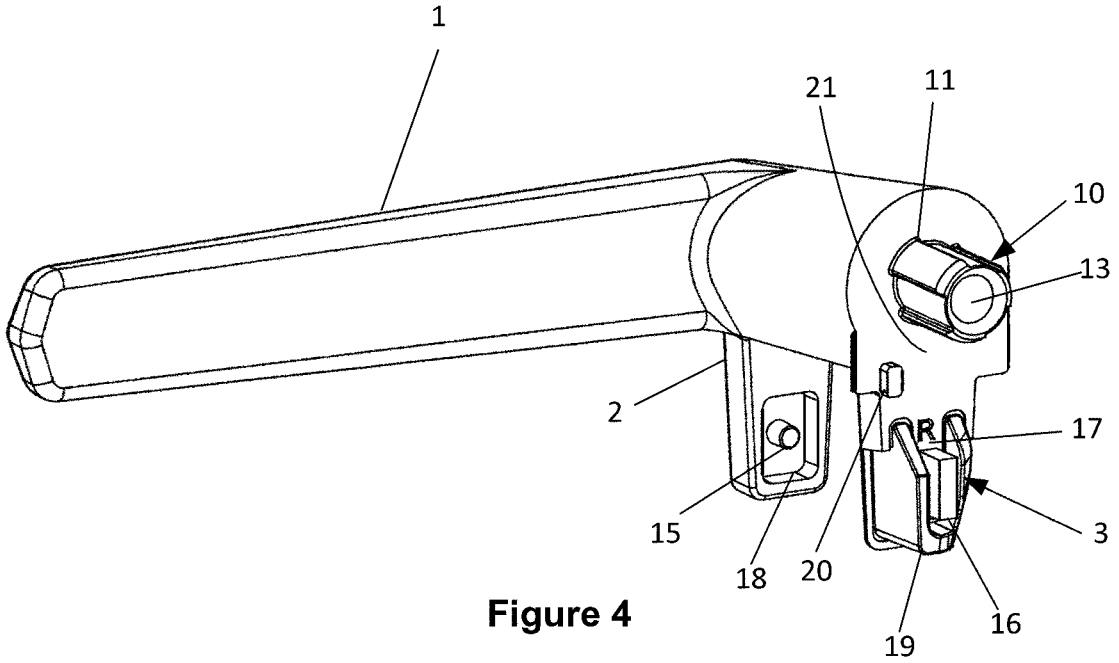
FIG. 4 is a back-perspective view of a handle.

FIG. 4 is a back-perspective view of a handle 1. The handle 1 provides an ergonomic lever to grip and provide leverage to the mechanism. One end of the handle 1 fixes to the base 5 of the fastener via a boss 10. In the embodiments shown, the boss 10 includes three key slots 11 complementary to formations on the tongue washer 6 and rear washer 7, to rotationally align the handle 1, the tongue washer 6 and rear washer 7. Any other suitable key configuration may be used to rotationally align the handle 1, tongue washer 6 and rear washer 7. For example, a different number of key slots may be included. Any shape or number of keys that are capable of transmitting the load between the handle and the washers may be used. The keys may be asymmetrically designed in a way so that the washers can only be attached in one orientation to prevent an incorrect assembly of the product. The width of the key slots 11 may be approximately the same as the width of the spaces around the boss 10 between the key slots 11.

An internal hole 13 of the boss 10 provides a means of securing all the components which make up the fastener together via a screw 9 fitting into the hole 13.

A stop 20 protrudes from the back face of the handle 1, below the boss 10. The stop 20 is substantially cuboid, and may protrude around 1.3 mm. The stop 20 can limit the rotation of the handle 1 beyond a closed position by interacting with stop 520 or another surface, such as on the base 5.

The handle 1 may be die cast zinc, or any other suitable material including but not limited to, polymers, aluminium and other metals.

The latching tongue 3 includes a recess 17 defined by a wall 19 to retain a wear surface 601 which is integral with the tongue washer 6. In other embodiments, the wear surface may be a separate piece from the tongue washer 6, may be integral with the latching tongue of the handle 1, or may be omitted. In the centre of the recess 17 of the latching tongue 3 there is a post 16 which the tongue washer 6 grips onto so that the tongue washer 6 is held firmly against the handle 1. The washer portion of the tongue washer 6 has an internal profile complementary to that of the boss 10 as the tongue washer 6 includes three keys 611 fitting into the key slots 11 of the boss 10. In other embodiments, the washers may include key slots and the boss may include keys.

The venting tongue 2 includes a recess 18 and post 15 to retain a venting button 12 acting as a wear surface. The venting button 12 may be omitted. A wear surface may be provided integrally with the venting tongue.

Non-Venting Fasteners

The embodiments shown depict venting fasteners which include a second, venting tongue 2. However other embodiments may omit the venting tongue 2.

Other embodiments may include a high-profile version, which omits the venting tongue 2 but has an otherwise similar handle. Another embodiment may be a low-profile version, which again omits the venting tongue 2 and the lever section of the handle 1 is closer to the boss 10 providing a solution for installations where space for the handle 1 to protrude from the sash is limited.

In yet further embodiments, the venting tongue 2 may project from an opposing side of the handle 1 to the latching tongue 3. The fastener may thus be moved into a venting configuration by rotating the handle 180 degrees from the closed position.

Tongue Washer 6

Figure 5:
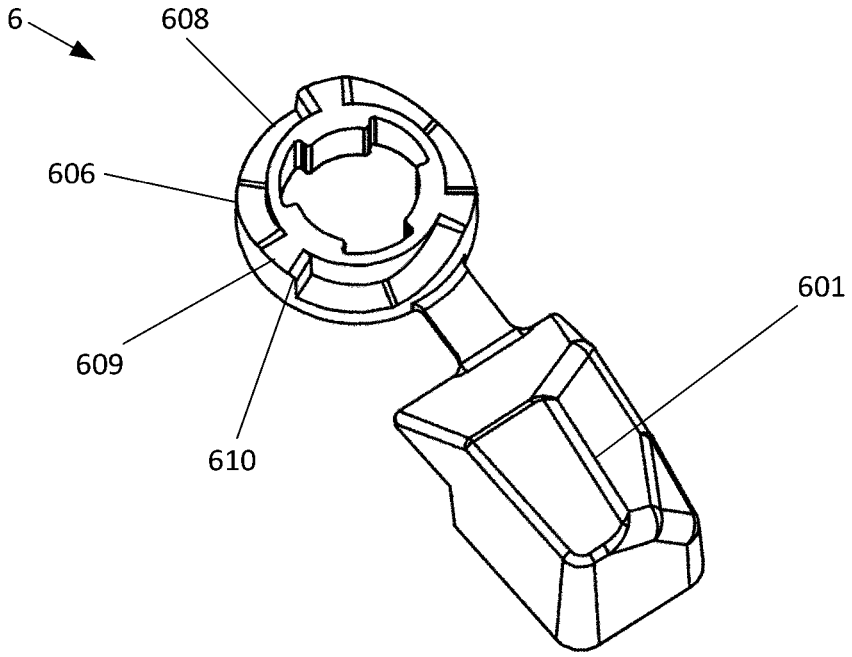
FIG. 5 is a front perspective view of a tongue washer.
Figure 6:
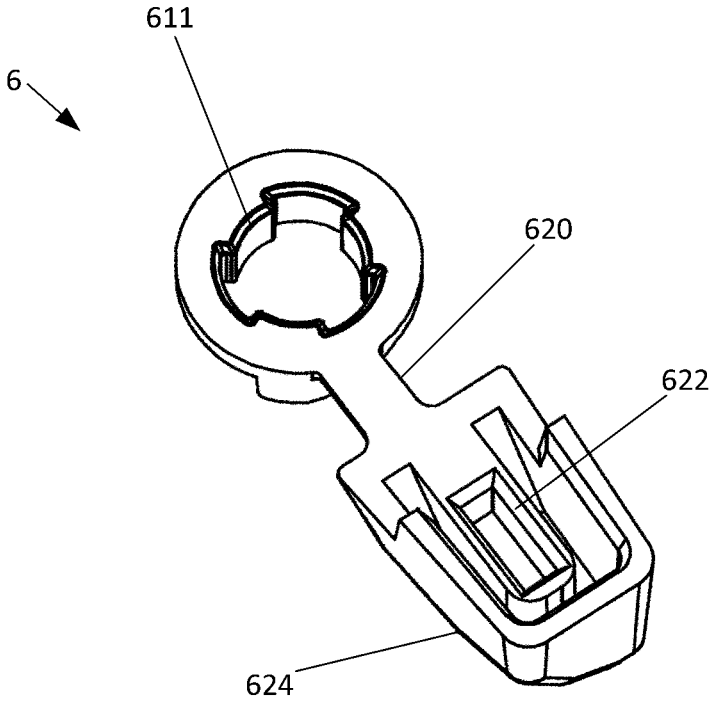
FIG. 6 is a back perspective view of the tongue washer of FIG. 5.

FIG. 5 is a front perspective view of a tongue washer and FIG. 6 is a back-perspective view of the tongue washer of FIG. 5. The tongue washer 6 includes a set of surfaces 606, 608, 609 to interact with the corresponding surfaces 506, 508, 509 on the front side of the base 5 to provide the axial movement as the handle 1 is turned. The surfaces 609 are open bearing surfaces, the surfaces 606 are ramped lifting surfaces, and the surfaces 608 are closed bearing surfaces. The surfaces 606, 608, 609 of the tongue washer 6 may act as a cam follower on the surfaces 506, 508, 509. The tongue washer 6 is locked rotationally to the handle 1 by the same key as the rear washer 7. The tongue washer 6 also includes a bridging web 620 which connects the washer portion of the tongue washer 6 to the wear surface 601. The wear surface 601 presses against the frame of the window when it closes. The tongue wear surface is contained within a locating recess 17 in the handle 1.

The tongue washer 6 may be manufactured from any suitable material, for example plastic. The material is preferably resistant to wear but not abrasive on the frame of the window. For example, the material may be selected to be softer than the surface finish of the frame of the window. The material preferably has high UV stability and heat resistance. In some cases, the wear surface may be a thermoelastic polyester elastomer.

Combining the tongue washer 6 with the wear surface 601 facilitates assembly, as it reduces the number of components that must be handled to put the whole fastener together. In other embodiments, the wear surface 601 might be a separate piece or button from the tongue washer 6.

Whilst it may be possible to omit the tongue washer 6, and instead have the boss 10 shaped with surfaces (such as those similar to surfaces 606, 608, 609) that interface with the base 5, this may increase the rate of wear as abrasive materials would be bearing against each other. For example, a zinc boss on a zinc base may not wear well.

The rear surface of the tongue washer 6 includes a retention chamber 622 moulded into the tongue washer 6, behind the wear surface 601. The retention chamber 622 retains the post 16 of the handle 1 via an interference fit to hold the tongue washer 6 firmly against the handle 1.

When the tongue washer 6 and the handle 1 are coupled, an outer wall 624 of the tongue washer 6 overlaps the wall 19 of the latching tongue 3. Wall 19 is therefore sandwiched between outer wall 624 of the tongue washer and outer face of the retention chamber 622, and may have a snug fit.

This results in a relatively firm coupling between the tongue washer 6 and the handle 1. This may also provide improved protection against impact damage to the window frame during incorrect operation. For example, this can avoid the latching tongue 3 making contact with a metal face of a window frame when the handle 1 is rotated towards the closed position before the window sash has been completely pulled against the window frame.

Base 5

Figure 7:
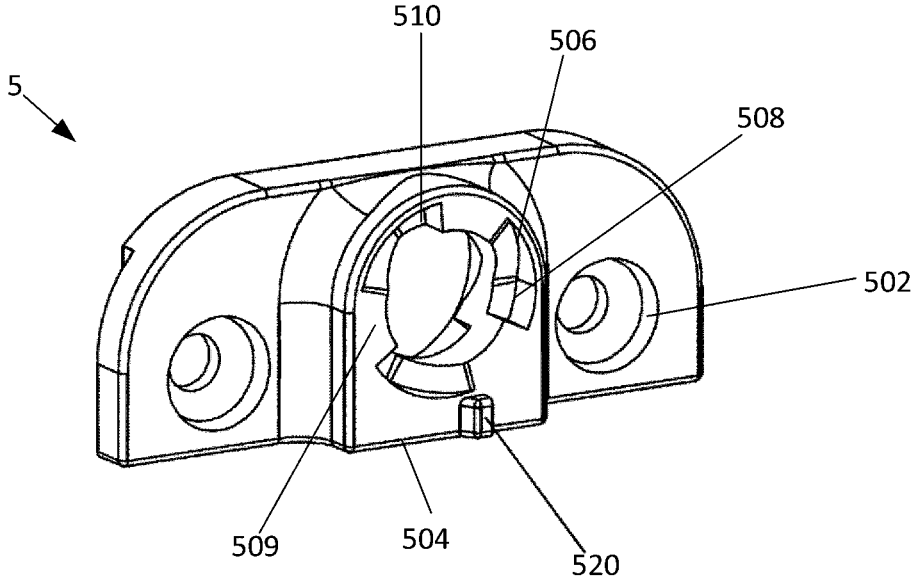
FIG. 7 is a front perspective view of a base.
Figure 8:
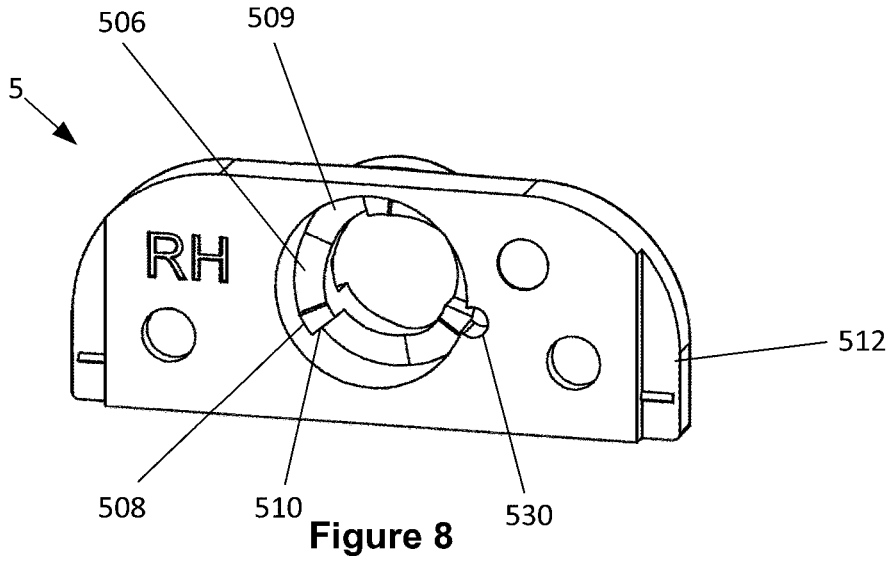
FIG. 8 is a back-perspective view of the base of FIG. 7.

FIG. 7 is a front perspective view of the base 5, and FIG. 8 is a back-perspective view of the base of FIG. 7.

The front of the base 5 includes a set of surfaces 506, 508, 509, on the front of the base 5 to interface with the surfaces 606, 608, 609 of the tongue washer 6. The surfaces 506, 508, 509 act as cam surfaces, as they translate the rotary motion of the handle 1 into axial motion, moving the handle axially towards or away from the base 5 depending on the direction of rotation. The surfaces 509 are open bearing surfaces, the surfaces 506 are ramped lifting surfaces and the surfaces 508 are closed bearing surfaces. The sets of surfaces are separated at three stops 510.

Including three sets of surfaces and stops provides stability to the handle. Including two or less sets of surfaces may form a pivot and thus create instability in the handle. This would cause extra wear of the round bearing surfaces as they would then have to support the joint more. Over time these may wear and the joint may become loose.

Including more than three sets of surfaces is possible, but is limited by the operating angle. In embodiments with a 90° operating angle, the 360° of the boss is then divided by 90° giving a theoretical possibility of four sets of surfaces and stops. Three sets of surfaces and stops provides suitable sizing for carrying load, providing support, and inherent stability. In other embodiments with a reduced opening angle, a greater number of cams or ramps may be included.

The base 5 may be die cast zinc, or made from any other suitable metal. It could be made of plastic, providing strength and wear requirements are met.

The height difference between closed bearing surface and open bearing surface on the tongue washer 6, rear washer 7 and base 5 is matched (as the profile is replicated on all three parts). In the shown embodiments, the height difference is about 2.5 mm. The height difference could be smaller or greater if the profile of the cams or ramps are adjusted.

Similarly, the slope of the ramps is matched on the profiles of the tongue washer 6, rear washer 7 and base 5. In the shown embodiments, a 2.5 mm height change is provided over 45° of rotational movement of the handle 1. The slopes of the ramps may be constant, or varied (for example, starting gradually and then increasing once the handle had begun moving).

The cam surfaces may be between 1.8 mm to 1.9 mm thick. If the overall product is bigger or smaller, this may be varied.

A stop 520 protrudes from the front of the base 5, below the surfaces 506, 508, 509. The stop 520 is substantially cuboid, and may protrude around 1.3 mm from the front of the base 5. The stop 520 can limit the rotation of the handle 1 beyond a closed position by interacting with another surface, such as a rear surface 21 of the handle 1. This resists further rotation of the handle 1 beyond the closed position, which could otherwise damage the fastener. In this way, stop 520 functions as a deadstop. Both stop 520 and stop 20 may be made of a relatively strong material, such as a metal, such that it is difficult or impossible for a user to force the handle 1 to rotate beyond the closed position by hand.

The rear of the base 5 includes corresponding surfaces 506, 508, 509 interfacing with the surfaces 706, 708, 709 on the rear washer 7. The surfaces 709 are open bearing surfaces, the surfaces 708 are closed bearing surfaces, and the surfaces 706 are ramped lifting surfaces. The surfaces 706, 708, 709 of the rear washer 7 may act as a cam follower on the surfaces 506, 508, 509.

Figure 9:
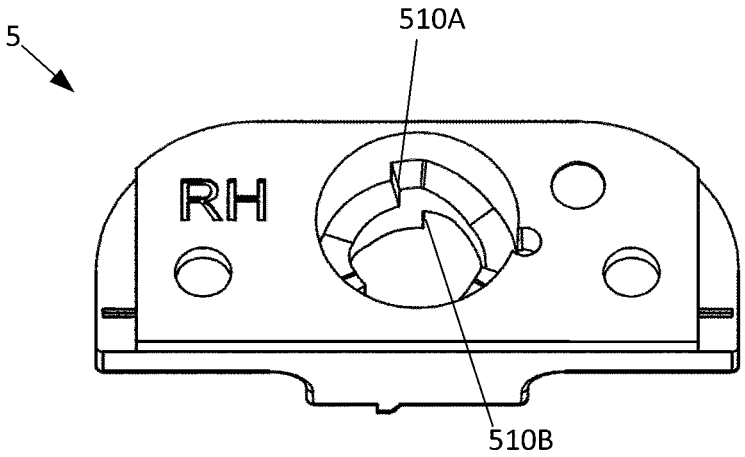
FIG. 9 is a detailed view of the cam surfaces of FIG. 8.

The features on the back of the base 5 are offset rotationally from the features on the front. FIG. 9 shows a detailed view of the surfaces 506, 508, 509 of FIG. 8. The stop surface 510A is offset rotationally from the stop surface 510B. This ensures that the base 5 is sufficiently thick and strong in all areas. This is an example of how front and rear surfaces are offset rotationally to avoid points of weakness.

The rear of the base 5 may include an alignment recess 530 configured to match an alignment pin 730 projecting from the side of the rear washer 7. The alignment recess 530 and the alignment pin 730 both have a generally circular cross-section. The alignment recess 530 and alignment pin 730 can assist in aligning the rear washer 7 with the base 5 during assembly. Additionally, there may be multiple matching sets of recesses 530 and pins 730.

The centre boss 504 of the base 5 between retaining ledges 512 is thicker to house the rear washer 7. The base 5 includes a pair of countersunk holes 502 to affix the fastener to the sash of the window. Retaining ledges 512 hold the cover 4 which conceals the fixing screws. The thickness of the base 5 at the fixing screw locations is kept relatively thin (and may be as thin as possible) while still retaining sufficient strength in the component (and preferably as much strength as possible). This may be dictated by regulatory standards for handle forces for operating a window. In some embodiments, the handle forces for operating a window are less than 90N to initiate and sustain movement of a projecting sash. A minimal base thickness at the fixing screw locations allows the latching tongue 3 to clear the base 5 and cover 4 as the latching tongue 3 rotates and moves axially.

Spring

In some embodiments, a spring may be provided to act on the rear washer 7 to hold the fastener in either the open or closed position. For example, this may be in the form of a moulded plastic leaf spring with a pre-load to act on the rear washer 7. The spring can include one or more posts to locate and be retained via a press fit into the base 5. Alternative methods of fixing the spring to the base 5 could also be used, such as swaging or riveting the base to retain the spring. A detent protuberance of the spring can act on the outside face of the rear washer 7, seating into two detent positions of the rear washer 7. This can provide a positive feel to the handle 1 when it reaches either of the two positions at each end of the handle's travel, holding the handle 1 in either the open or closed positions.

The spring may be manufactured from any suitable material, such as a plastic that provides good performance in terms of wear and retaining elasticity to provide an effective detent throughout the life of the product.

Alternatively, the pre-loading of the rear washer 7 may be achieved by a helical spring ball bearing combination or various other sprung articles.

Rear Washer 7

Figure 10:
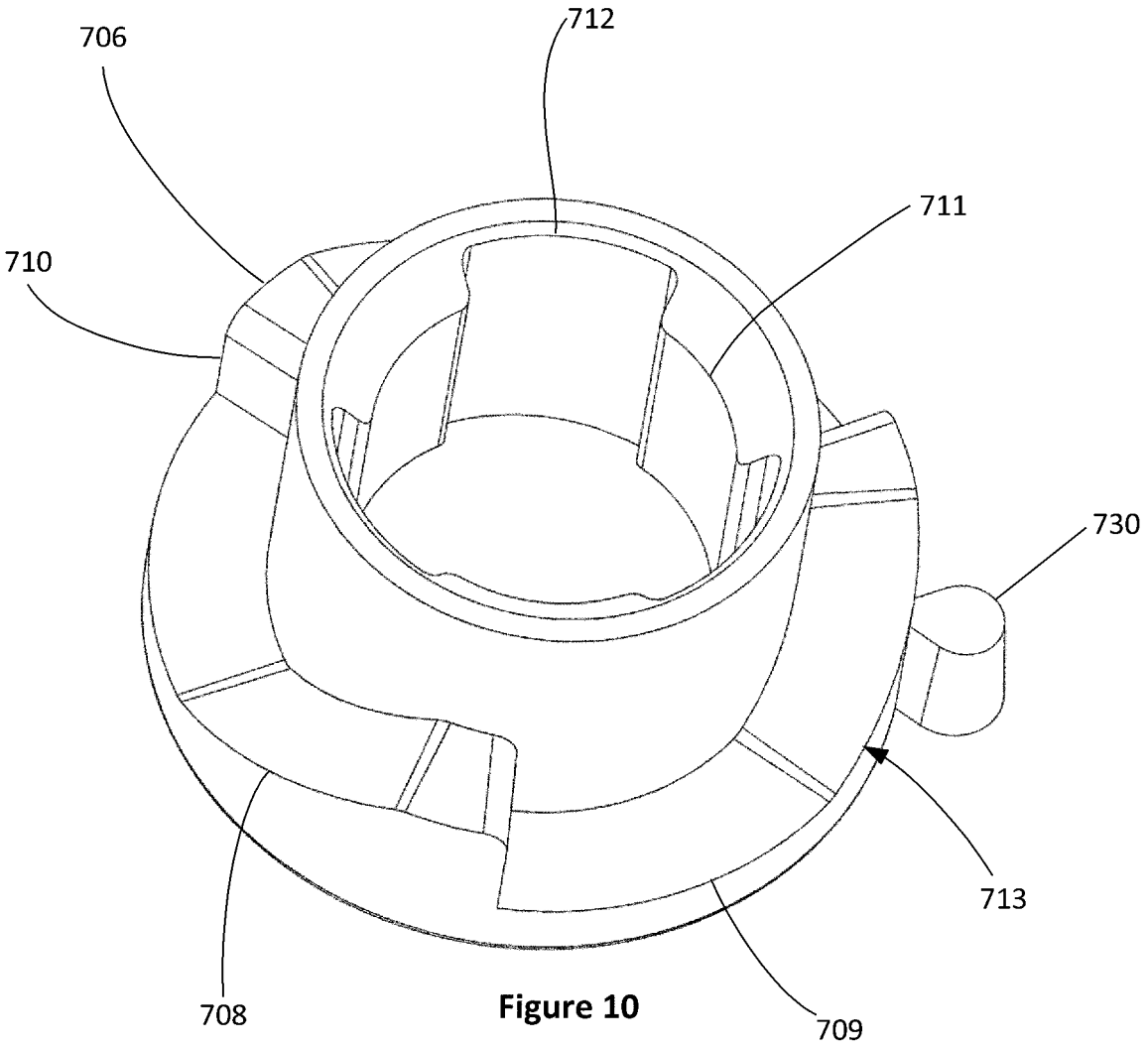
FIG. 10 is a perspective view of a rear washer.

FIG. 10 is a perspective view of a rear washer 7. The rear washer 7 includes a central boss 712 including keys 711 which lock the rotation of the rear washer 7 to the handle 1. Beyond the boss 712 there is a flange 713 having surfaces 706, 708 and 709 which act as bearing surfaces and lifting profiles, and stops 710. These surfaces are patterned three times around the washer.

The rear washer 7 may be any suitable material (for example, zinc or plastic).

The rear washer 7 allows the screw to bind all the elements of the joint together by providing complementary cam or ramped lifting surfaces to the front washer to allow the handle to rotate through its full motion.

The front and rear washer have the same surface profiles as they are subjected to the same rotational and axial movement and are fixed together by the screw.

The rear washer may include an alignment pin 730 configured to match an alignment recess 530 set into the rear of the base 5. The alignment recess 530 and the alignment pin 730 both have a generally circular cross-section. The alignment recess 530 and alignment pin 730 can assist in aligning the rear washer 7 with the base 5 during manufacture. Additionally there may be multiple matching sets of recesses 530 and pins 730.

Venting Button 12

Figure 11:
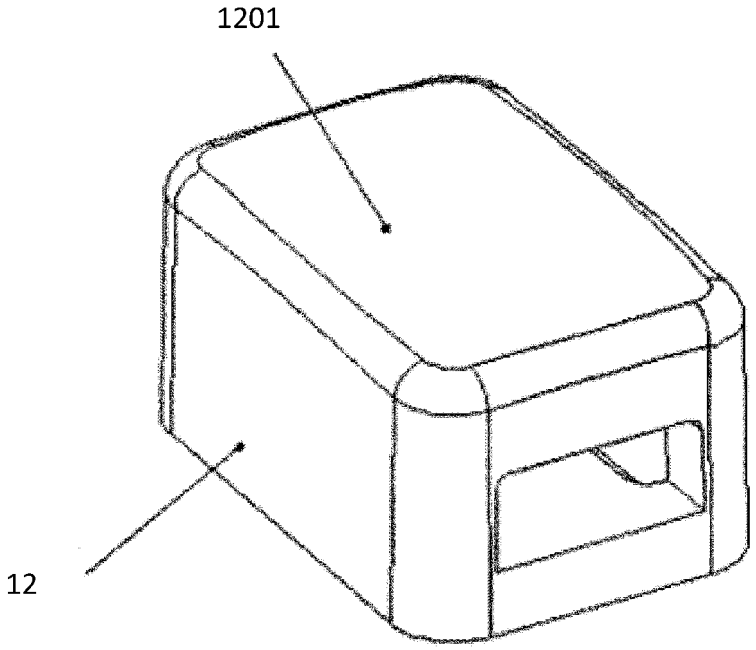
FIG. 11 is a top perspective view of a venting button.
Figure 12:
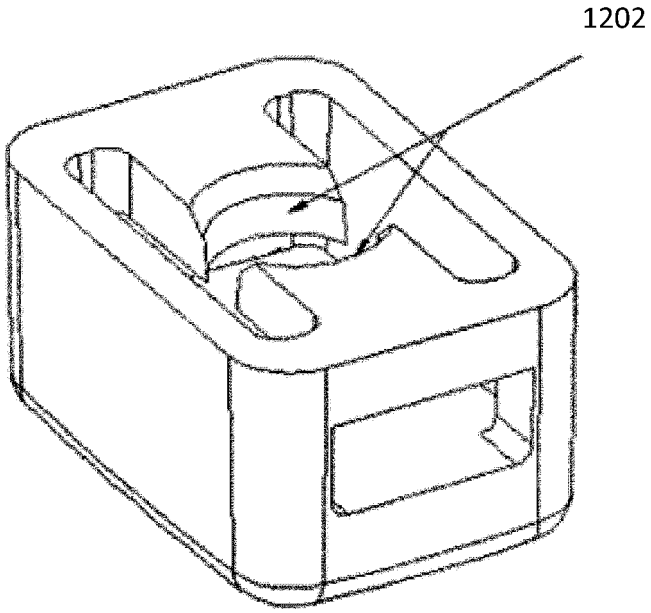
FIG. 12 is a bottom perspective view of a venting button.

FIG. 11 is a top perspective view of a venting button 12, and FIG. 12 is a bottom perspective view of the venting button 12. The venting button 12 performs a similar function to the wear surface 601 on the tongue washer 6. However, the wear demands are less as the venting button 12 is not compressed against the frame. The venting button 12 prevents the handle 1, specifically the venting tongue 2, from scratching the surface finish of the frame when the handle 1 is in the venting position. The engagement surface 1201 of the venting button 12 is formed of a suitable material to avoid damaging the surface finish of the frame. For example, a relatively soft plastic may be used. The venting button 12 is held on to the post 15 on the venting tongue 2 of the handle 1 by retention fingers 1202.

Screw 9

Figure 13:
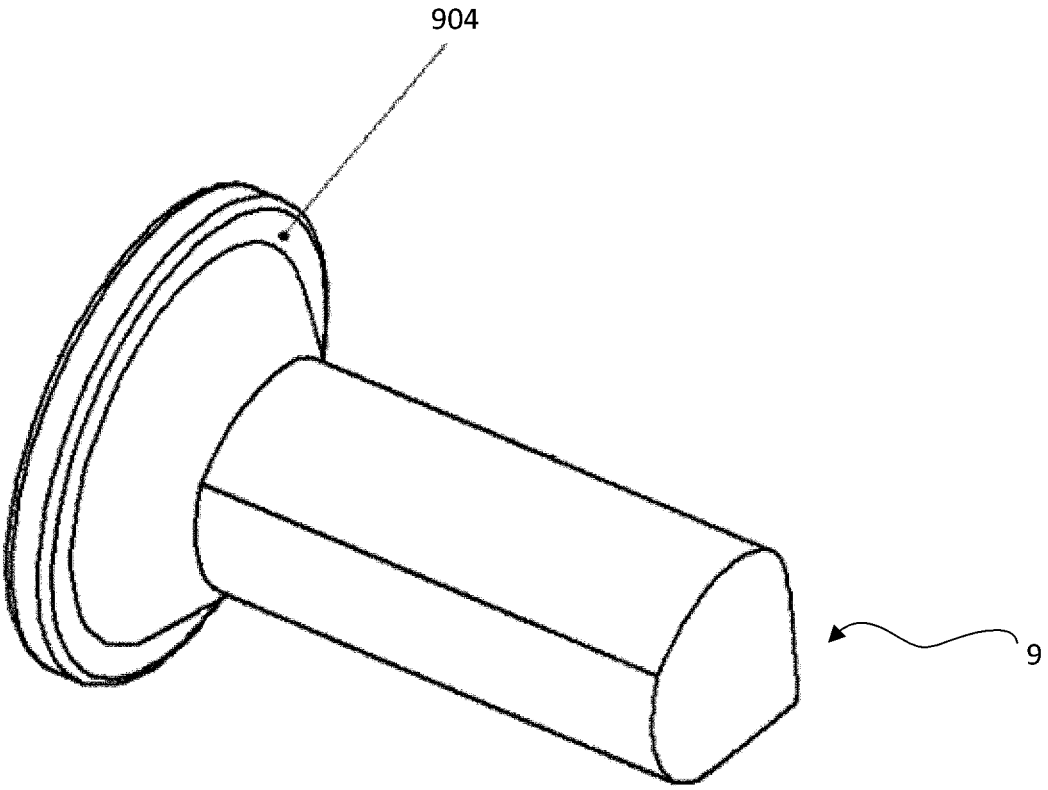
FIG. 13 is a perspective view of a screw.
Figure 14:
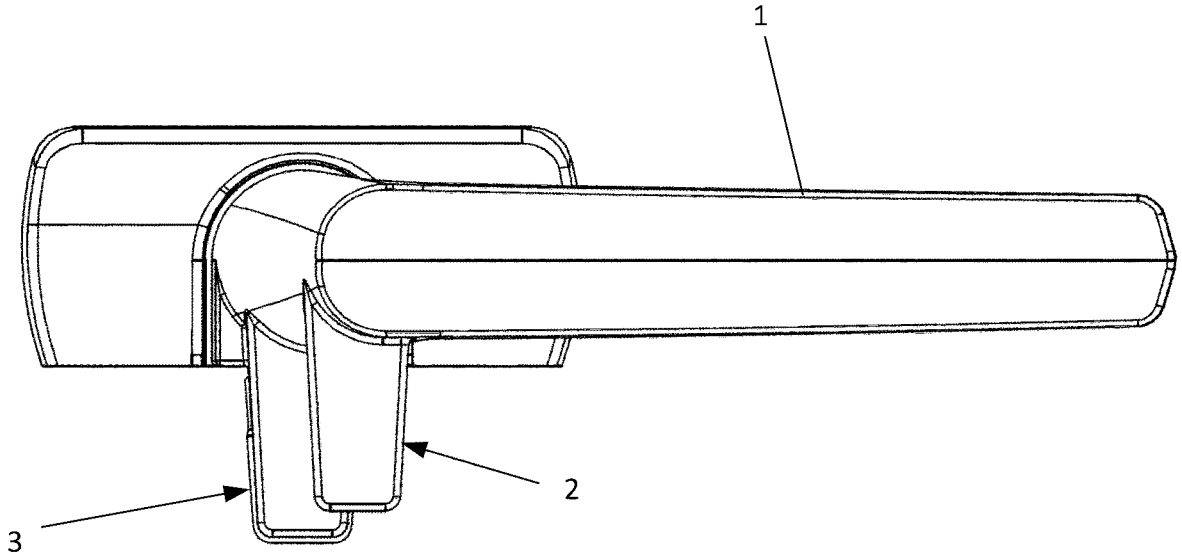
FIG. 14 is a front view of a fastener in a closed position.
Figure 15:
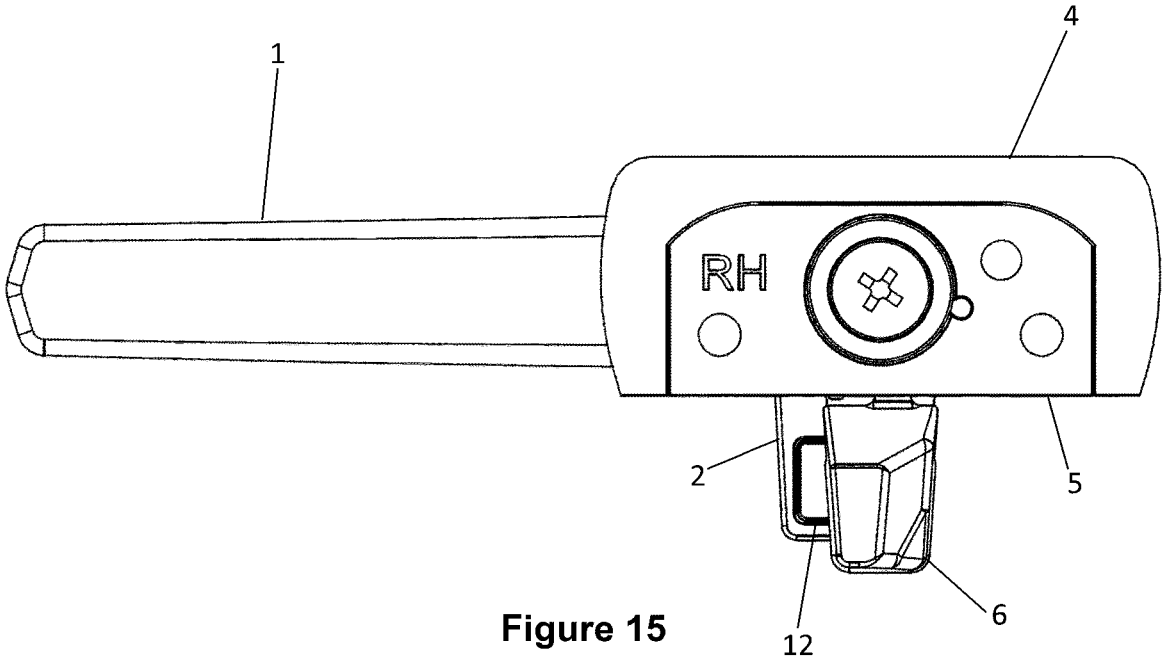
FIG. 15 is a back view of a fastener in a closed position.
Figure 16:
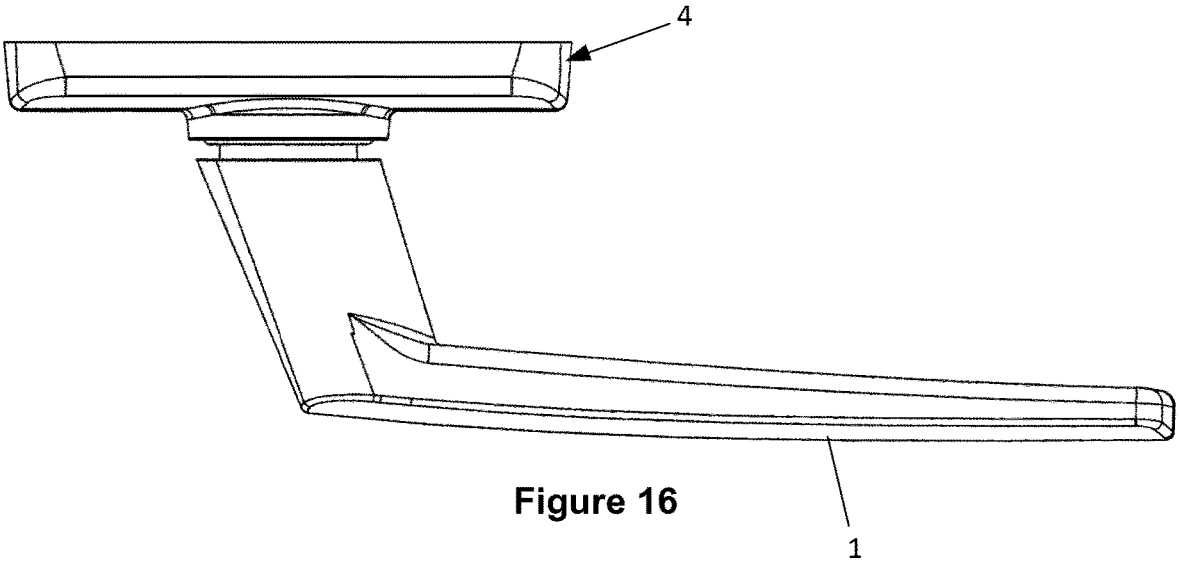
FIG. 16 is a top view of a fastener in a closed position.
Figure 17:
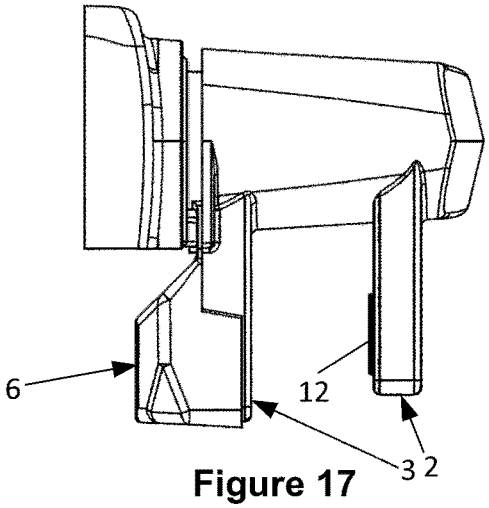
FIG. 17 is a side view of a fastener in a closed position.
Figure 18:
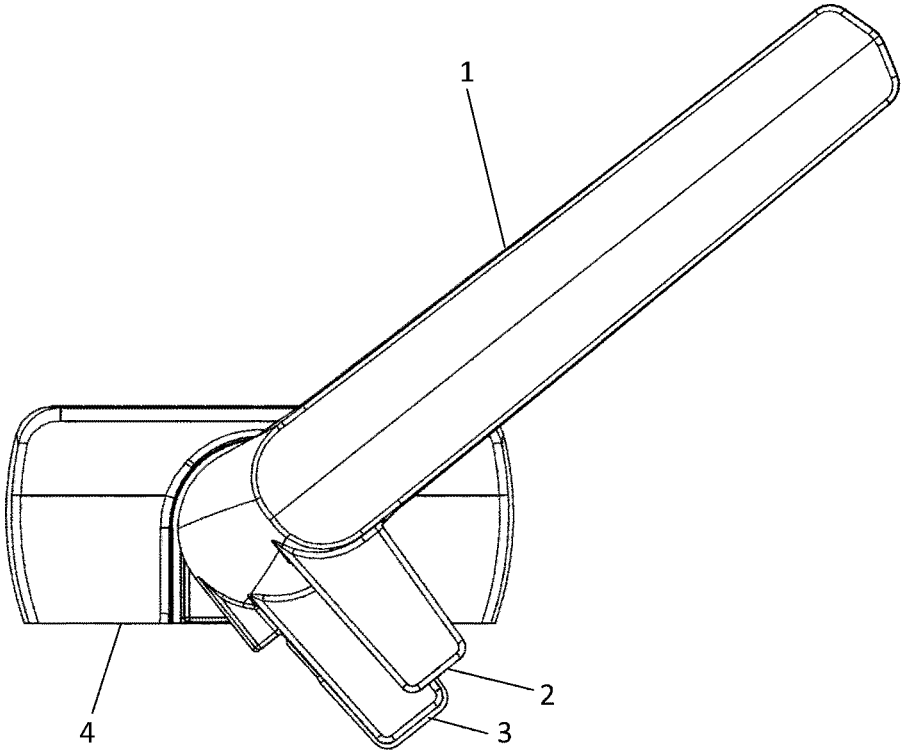
FIG. 18 is a front view of a fastener in a transitional position.
Figure 19:
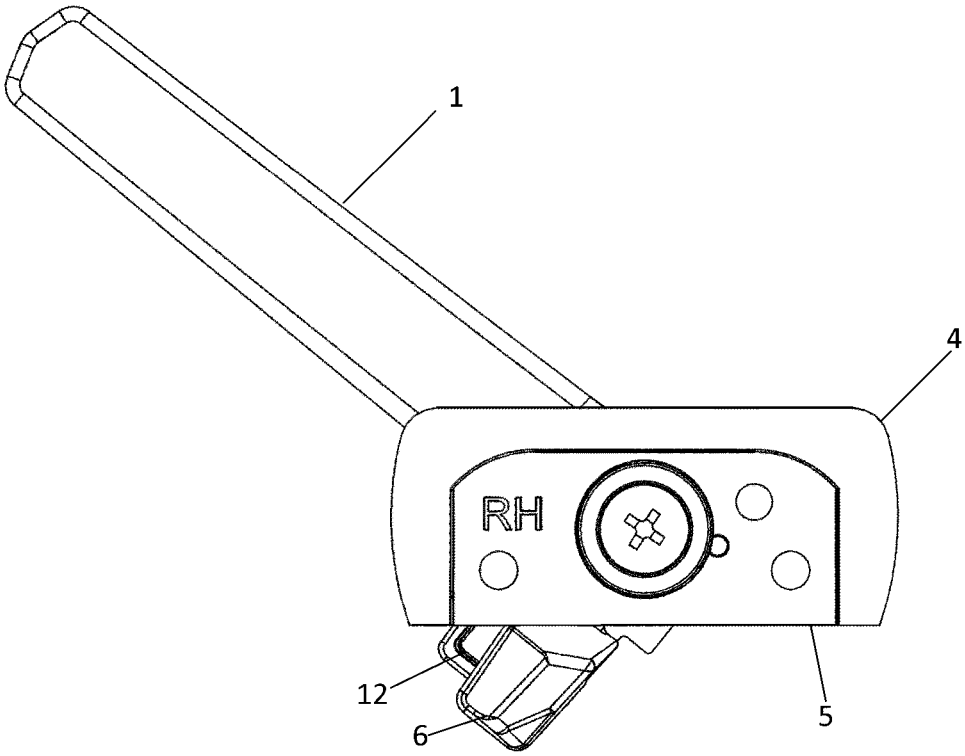
FIG. 19 is a back view of a fastener in a transitional position.
Figure 20:
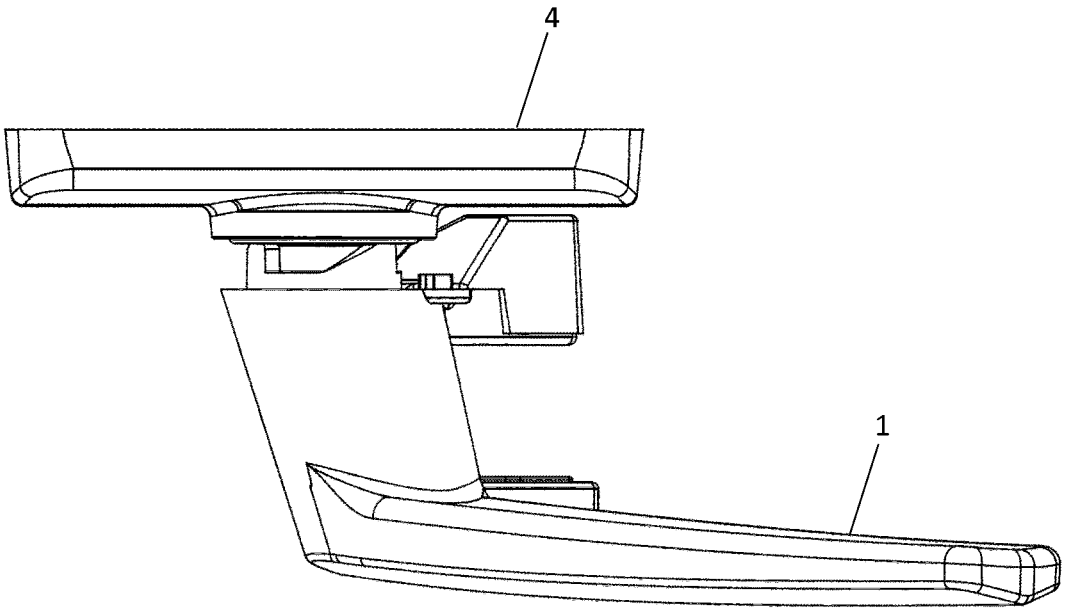
FIG. 20 is a top view of a fastener in a transitional position.
Figure 21:
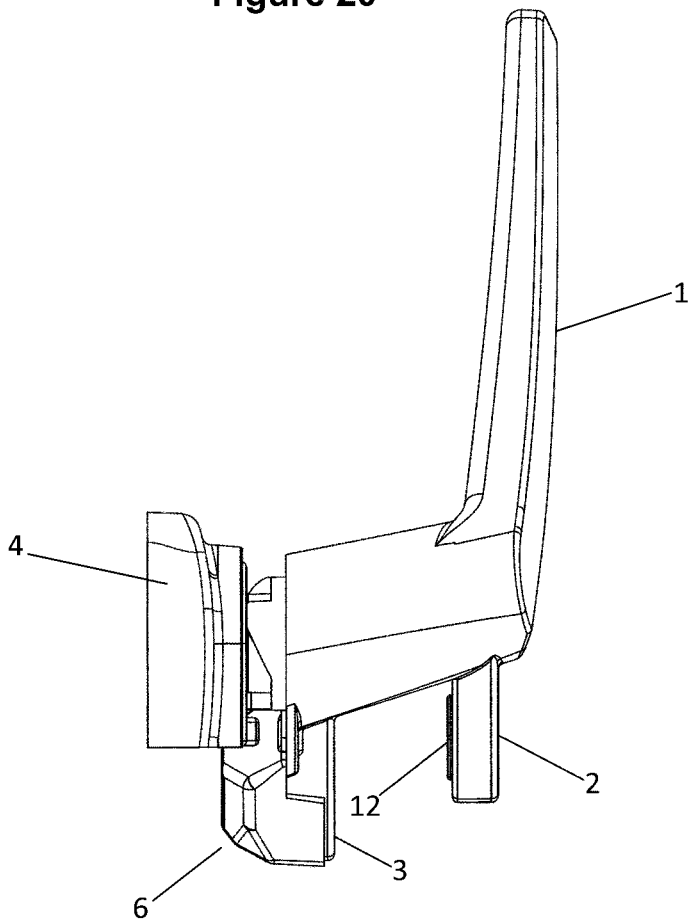
FIG. 21 is a side view of a fastener in a transitional position.
Figure 22:
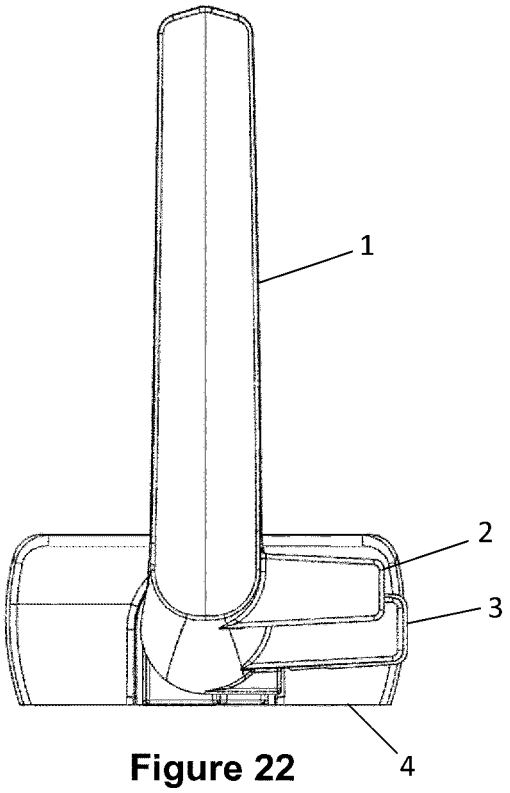
FIG. 22 is a front view of a fastener in an open position.
Figure 23:
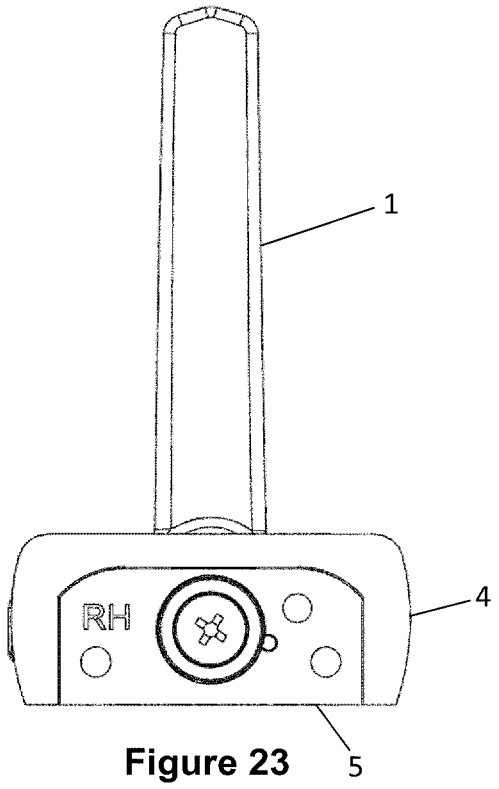
FIG. 23 is a back view of a fastener in an open position.
Figure 24:
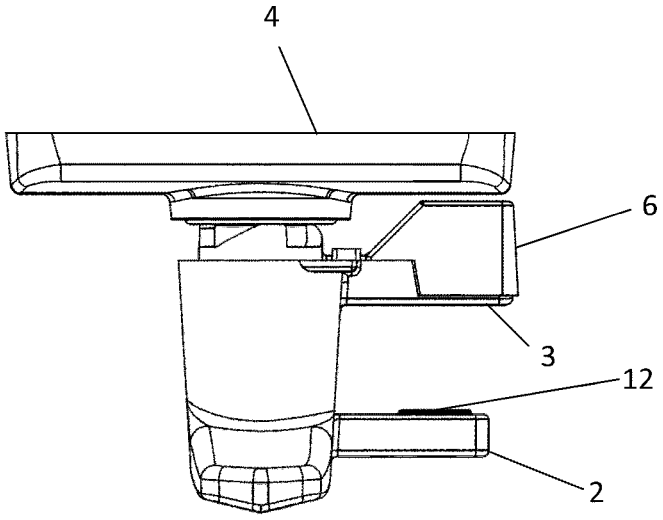
FIG. 24 is a top view of a fastener in an open position.
Figure 25:
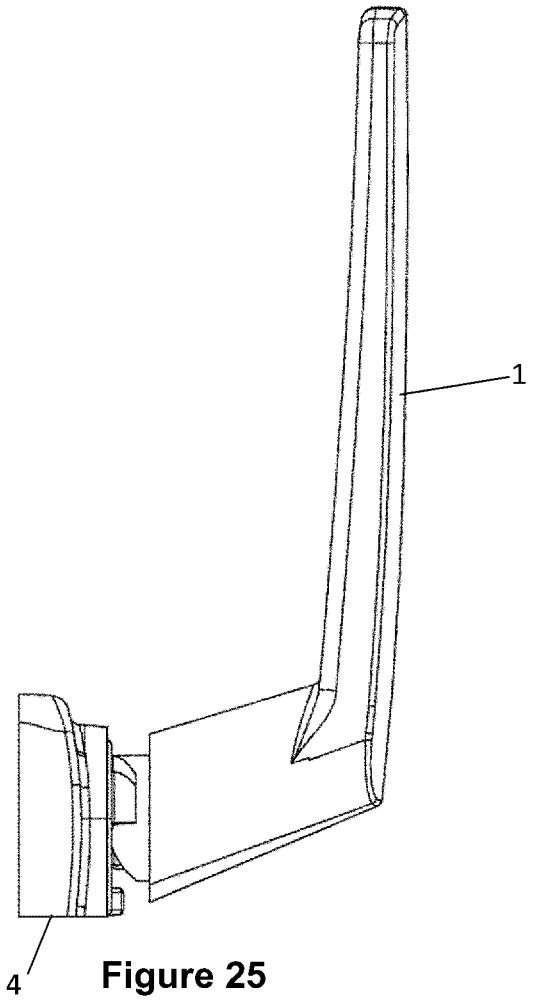
FIG. 25 is a side view of a fastener in an open position.

FIG. 13 is a perspective view of a screw 9. The screw 9 may secure the individual components into an assembled mechanism. The screw 9 in the shown embodiments is a trilobular screw 9 to fix from the rear of the fastener into the handle 1. The function could also be achieved through a riveting process.

The extended lip 904 on the head of the screw 9 allows for more surface area to apply pressure to hold all components together in a functional assembly.

Friction

In some embodiments, the assembly may be configured to have sufficient friction such that the handle 1 tends to stay in place unless operated by a user. For example, when a user places the handle 1 in a partially open position (such as 45 degrees from the fully closed position), the friction is sufficiently high that the assembly can retain the weight of the handle 1 in place until a user further engages the handle 1. For example, the assembly may be configured such that a torque of between about 2.5 Nm to about 5 Nm may be required to move the handle 1.

This may be implemented by forming one or both of the tongue washer 6 and the rear washer 7 of a material having a suitable friction compared to the base 5. In addition, material may be selected to be resistant to wear so that the assembly maintains sufficient friction throughout its life.

Operation

Other mechanisms translating rotational motion into axial motion may be provided. For example, a thread may be provided to translate the rotational motion of the handle 1 into axial movement of the latching tongue 3 toward and/or away from a flap. The base 5 may include a threaded aperture, and the handle 1 may include a threaded boss which screws into the threaded aperture of the base.

In the shown embodiments, translation of rotational motion of the handle into axial motion is achieved using the two paired sets of ramped lifting surfaces or cams. A first set of ramped lifting surfaces 506 and 606 are provided on both the front side of the base 5 and the tongue washer 6. The base 5 remains stationary while the rotation of the tongue washer 6 and rear washer 7 are keyed to the handle 1. A second set of ramped lifting surfaces 506 and 706 are on the rear washer 7 and rear side of the base 5.

In the shown embodiments, the radial movement of the handle 1 of the fastener is from 0° to 90° from the closed extreme to the open extreme. In other embodiments, radial movement of the handle 1 may range between 0° to 180°.

FIGS. 14 to 17 are front, back, top and side views respectively of a fastener in a closed position. The stops 610 of the tongue washer abut the stops 510 of the base and the protruding surfaces 609 of the tongue washer are located adjacent surfaces 508 of the base 5. There is thus maximal overlap between the tongue washer 6 and the base 5, and thus the handle 1 and latching tongue 3 are maximally close to the base 5. When the fastener is in the closed position, the wear surface 601 of the tongue washer 6 is pressed against the frame of the window, compressing the window seals while the window is closed. Compressing the window seals protects against ingress of water and air.

FIGS. 18 to 21 are front, back, top and side views respectively of a fastener in a transitional position.

From the closed position, the first 45° of motion is both radial and axial, due to the ramped lifting surface features of the base 5 and the tongue and rear washers 7.

The ramped lifting surfaces 606 of the tongue washer 6 and the ramped lifting surfaces 706 of the rear washer 7 slide up the ramped lifting surfaces 506 of the base 5 decreasing the compression against the window frame by increasing the distance between tongue washer 6 and the base 5.

During the first 45° of opening, the wear portion of the latching tongue 3 rotates through an arc. The latching tongue 3 remains in contact with the window frame, however, due to the axial movement in the joint over the period, the pressure on the window seals is released. When the handle 1 has been rotated through the full 45° the motion transitions to just rotational movement. At this point, there is no pressure between the latching tongue 3 and the window frame as the axial movement is greater than the window seal compression distance. The remaining 45° of the opening arc of the handle 1 then is purely rotational movement with no further axial change, as the open bearing surface 609 of the tongue washer 6 and the open bearing surface 709 of the rear washer 7 slide on the open bearing surfaces 509 of the base 5.

FIGS. 22 to 25 are front, back, top and side views respectively of a fastener in an open position. To close the fastener, the handle 1 must be rotated in the direction in an opposite manner to the opening movement. During the first 45° of closing, the handle 1 moves purely rotationally as the open bearing surface 609 of the tongue washer 6 and the open bearing surfaces 709 of the rear washer slide on the open bearing surface 509 of the base 5. The last 45° of motion is both radial and axial, due to the cam features of the base 5, the tongue washer 6 and rear washer 7. The ramped lifting surfaces 606 of the tongue washer 6 and the ramped lifting surfaces 706 of the rear washer 7 slide down the ramped lifting surfaces 506 of the base 5 increasing the region of overlap between tongue washer 6 and the base 5.

In the present embodiments, the ratio of axial and rotational movement, to purely rotational movement is 1:1 (i.e. half of the travel is purely rotational). However, in other embodiments the ratio of axial and rotational movement, to purely rotational movement may be varied. Any proportion or ratio of the rotational movement may also include axial movement, so long as the tongue is able to clear the base 5 and cover 4.

Handedness

The embodiments describe right-handed components. Left-handed components may be provided, which are mirrored versions of the right-handed components. Features may be added or omitted from the left-handed components to prevent misassembled product being produced using a mixture of left and right-handed components. For assembly purposes, the left and right-handed washers and bosses may have different key configurations to prevent misassembly.

Method of Assembly

To assemble the fastener, the components may be stacked "upside down" onto the handle. First the tongue washer 6, the rear washer 7 and the base 5 may be fitted to the boss 10 in the correct orientation. The screw is driven through the stack into the handle to create the finished joint. The venting button 12, when present, may be added in a separate operation.

Method of Manufacture

Components may be die cast in zinc, moulded in plastic or produced by any other suitable methods for the respective material/s.

In the case of zinc components, the zinc components may be pre-treated for anti-corrosion if they are non-visible in the finished article, or powder coated or decorative plated for the visible components. In the case that the rear washer 7 is zinc, the rear washer 7 may be plated for wear resistance.

While the present invention has been illustrated by the description of the embodiments thereof, and while the embodiments have been described in detail, it is not the intention of the Applicant to restrict or in any way limit the scope of the appended claims to such detail. Additional advantages and modifications may readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

What is claimed is:

1. A window fastener including:

i. a base configured for connection to a window sash;

ii. a handle carrying a latching tongue, pivotally connected to the base to pivot, about an axis, between a latched position and an unlatched position;

iii. an interface between the base and the handle;

iv. a washer between the base and the handle, wherein the washer is rotationally aligned with the handle; and v. a rear washer, wherein the interface causes the latching tongue to move axially, with respect to the axis, closer to the base when the handle pivots from the unlatched position to the latched position;

wherein the interface causes the latching tongue to move axially, with respect to the axis, away from the base when the handle pivots from the latched position to the unlatched position;

wherein the interface includes a cam surface;

wherein the cam surface is a surface of the base and includes at least a closed bearing surface, a lifting surface, and an open bearing surface; and wherein the washer has a surface complementary to the cam surface of the base such as to overlap with the base, in use, when the fastener is in a latched position;

wherein the rear washer is positioned behind the cam surface of the base and rotationally aligned with the handle;

wherein the rear washer includes at least a closed bearing surface, a lifting surface, and an open bearing surface; and wherein the closed bearing surface, the lifting surface, and the open bearing surface of the cam surface respectively have the same profile as the closed bearing surface, the lifting surface, and the open bearing surface of the rear washer.

2. The window fastener of claim 1, wherein the base includes an aperture through which the handle is pivoted.

3. The window fastener of claim 1, wherein as the handle pivots, the washer surface acts as a cam follower on the cam surface.

4. The window fastener of claim 1, wherein the complementary surface is substantially concentric with the cam surface.

5. The window fastener of claim 4, wherein the washer is integral with a wear surface for the latching tongue.

6. The window fastener of claim 1, wherein the washer comprises a wall configured to overlap the latching tongue.

7. The window fastener of claim 1, wherein the cam surface is substantially circular.

8. The window fastener of claim 1, wherein the cam surface includes three sets of closed bearing surfaces, lifting surfaces and open bearing surfaces.

9. The window fastener of claim 1, wherein a keyed boss passing through the aperture rotationally aligns the rear washer with the handle.

10. The window fastener of claim 1, wherein a rear surface of the base includes cam surfaces, configured to interface with follower cam surfaces of the rear washer.

11. The window fastener of claim 1, wherein the handle further includes a venting tongue engageable, in use, with a window frame to keep the window ajar when the handle is in the venting position.

12. The window fastener of claim 1, wherein the interface includes a thread.

13. The window fastener of claim 1, wherein the base comprises a base stop, and the handle comprises a handle stop, the base stop and the handle stop being configured to resist the handle pivoting beyond the latched position.

14. The window fastener of claim 1, wherein the rear washer includes three sets of closed bearing surfaces, lifting surfaces, and open bearing surfaces.

* * * * *